US008820730B2

(12) United States Patent
Jiang et al.

(10) Patent No.: US 8,820,730 B2
(45) Date of Patent: Sep. 2, 2014

(54) BILL TRANSMISSION CHANNEL DEVICE

(75) Inventors: Zhuang Jiang, Guangzhou (CN); Zhiyong Liu, Guangzhou (CN); Dong Tan, Guangzhou (CN)

(73) Assignee: GRG Banking Equipment Co., Ltd., Guangzhou, Guangdong (CN)

( * ) Notice: Subject to any disclaimer, the term of this patent is extended or adjusted under 35 U.S.C. 154(b) by 0 days.

(21) Appl. No.: 13/395,193

(22) PCT Filed: Aug. 5, 2010

(86) PCT No.: PCT/CN2010/075732
§ 371 (c)(1),
(2), (4) Date: Mar. 9, 2012

(87) PCT Pub. No.: WO2011/029356
PCT Pub. Date: Mar. 17, 2011

(65) Prior Publication Data

US 2012/0169007 A1 Jul. 5, 2012

(30) Foreign Application Priority Data

Sep. 11, 2009 (CN) ..... 2009 1 0192288

(51) Int. Cl.
*B65H 5/22* (2006.01)
*B65H 29/00* (2006.01)

(52) U.S. Cl.
CPC ..... *B65H 29/00* (2013.01); *B65H 2403/942* (2013.01); *B65H 2701/1912* (2013.01); *B65H 2403/20* (2013.01)
USPC ..... 271/3.01

(58) Field of Classification Search
USPC ..... 194/206, 207; 209/534; 271/3.01, 279, 271/280, 287, 296, 297, 298, 299, 303, 305, 271/264
See application file for complete search history.

(56) References Cited

U.S. PATENT DOCUMENTS 3,924,847 A * 12/1975 Pescetto ..... 271/3.14
4,348,656 A * 9/1982 Gorgone et al. ..... 382/135
6,422,458 B1 7/2002 Katou et al.

(Continued)

FOREIGN PATENT DOCUMENTS

CN 1532778 A 9/2004
CN 2683266 Y 3/2005

(Continued)

OTHER PUBLICATIONS

International Search Report dated Nov. 18, 2010 from corresponding International Application No. PCT/CN2010/075732.

*Primary Examiner* — Thomas Morrison
(74) *Attorney, Agent, or Firm* — Wolf, Greenfield & Sacks, P.C.

(57) ABSTRACT

A bidirectional bill transmission channel device (02) with multi-path steering, which is arranged between an upper core (01) having functions of recognizing and separating bill and a lower core (03) for storing bill, is used for transmitting and separating bill in a reversing way. The device (02) comprises a channel bracket (0200), a power shaft (0203) mounted on the channel bracket (0200), a transmission belt (0202), channel boards (02041, 02042), an auxiliary transmission wheel set (0205) and a corner guide plate (0210), wherein floating wheels (0211, 0211') are provided in a steering transmission route formed by the corner guide plate (0210) and the power shaft (0203), the floating wheels (0211, 0211') correspond to the power shaft (0203) for transmission belt (0202), and form rolling friction assembly with the belt (0202).

7 Claims, 5 Drawing Sheets

(56) References Cited

U.S. PATENT DOCUMENTS

| | | | | |
|---|---|---|---|---|
| 6,572,013 | B2 | 6/2003 | Katou et al. | |
| 6,889,898 | B2 | 5/2005 | Katou et al. | |
| 7,011,201 | B2 | 3/2006 | Katou et al. | |
| 7,464,921 | B2 | 12/2008 | Katou et al. | |
| 7,644,914 | B2 | 1/2010 | Katou et al. | |
| 2002/0170956 | A1 | 11/2002 | Katou et al. | |
| 2003/0038062 | A1 * | 2/2003 | Werner et al. | 209/534 |
| 2003/0205618 | A1 | 11/2003 | Katou et al. | |
| 2004/0140175 | A1 | 7/2004 | Guindulain Vidondo | |
| 2004/0182677 | A1 | 9/2004 | Katou et al. | |
| 2007/0221469 | A1 | 9/2007 | Katou et al. | |
| 2009/0085274 | A1 | 4/2009 | Katou et al. | |
| 2010/0164161 | A1 | 7/2010 | Katou et al. | |

FOREIGN PATENT DOCUMENTS

| | | | |
|---|---|---|---|
| CN | 2892773 | Y | 4/2007 |
| CN | 101673426 | A | 3/2010 |
| CN | 101673429 | A | 3/2010 |
| KR | 20070003386 | A | 1/2007 |

* cited by examiner

BILL TRANSMISSION CHANNEL DEVICE

This application is a National Stage application of PCT/CN2010/075732 filed on Aug. 5, 2010, which claims the benefit of Chinese patent application No. 200910192288.6 titled "Banknote Conveying Channel Device" and filed with the State Intellectual Property Office on Sep. 11, 2009. Both the international application and the Chinese application are incorporated herein by reference in their entireties.

FIELD OF THE INVENTION

The present invention relates to a banknote conveyor, and in particular, to a two-way banknote conveying channel device with multipath redirection.

BACKGROUND OF THE INVENTION

Conventional self-serving financial terminals include: automated cash deposit machines, automated cash withdrawal machines, and automated cash deposit and withdrawal machines. To realize banknote exchange between users and machines, all these paper money handling machines are equipped with a banknote conveying channel device, which is used to convey banknotes that the user wants to deposit to the vault, and/or convey banknotes from the vault to the user.

Particularly, the banknote conveying channel device in an automated cash deposit and withdrawal machine is used to convey sorted banknotes from an upper machine interior to the vault in a lower machine interior for storage, or, to convey banknotes stored in the vault to the upper machine interior after sorting. The upper machine interior may include a banknote identification device, a banknote temporary storage device and a banknote collection device. The banknote collection device is for the user to take out or put into banknotes. The lower machine interior includes the vault for storing banknotes.

In conventional banknote conveying channel devices, banknotes undergo several redirections in the vertical plane while being conveyed from the upper machine interior to the vault. When the angle is less than 90 degrees, the conventional conveying channel device normally uses two belts to contain the banknotes being carried. This conveying method needs a lot of space and may cause banknote jams, hence deteriorating reliability of the cash recycling machine as a whole.

In addition, in the case where the lower machine interior includes multiple cash boxes, multiple channel boards and redirection mechanisms are required for conveying banknotes to respective desired cash boxes. For the conventional conveying channel device to work properly, its cash box rack has to be fully filled with cash boxes, inevitably affecting operational performance and efficiency of the machine and utilization of cash boxes.

SUMMARY OF THE INVENTION

In order to solve the problem that conventional conveying channels require a lot of space for redirection in the vertical plane and may cause banknote jams, the present invention provides a banknote conveying channel device.

To solve the problem of lack of independence of conventional conveying channels of cash boxes, the present invention provides another improved banknote conveying channel device.

The objects of the invention are realized by the following:

The banknote conveying channel device is arranged between an upper machine interior for banknote identification and banknote sorting and a lower machine interior for banknote storage, and is adapted to convey, with redirection, and to separate banknotes. The device includes: a channel support, adapted to be mounted with the banknote conveying channel; a conveying belt, tensioned on a drive shaft and adapted to convey a banknote; a channel board, arranged on the channel support and including an upper channel board and a lower channel board, wherein a banknote conveying path is formed between the upper channel board and the lower channel board, the conveying belt is sandwiched between the upper channel board and the lower channel board, and the banknote is conveyed by the conveying belt in the path formed by the upper channel board and the lower channel board; at least one auxiliary conveying wheel set, arranged on the channel support and adapted to cooperate with the conveying belt for power transmission; and a redirection guiding plate, arranged at an end of the conveying channel device where the banknote enters, and forming a banknote redirection path with the conveying belt, wherein at least one floating wheel is arranged in the redirection path, the floating wheel is fitted with the drive shaft of the conveying belt such that the conveying belt is sandwiched between the floating wheel and the drive shaft, and the floating wheel and the conveying belt form a rolling friction-based assembly.

Preferably, a floating wheel is arranged at each of an entrance and an exit of the redirection path.

Preferably, a rubber drum is arranged on the drive shaft, and the conveying belt is tensioned on the rubber drum such that the conveying belt and the floating wheel rotate in opposite directions.

Preferably, the floating wheel is mounted on the redirection guiding plate via a mounting plate, the mounting plate includes two elastic arms, the two elastic arms clamp a floating wheel axle, and the floating wheel axle is fitted with a rotating wheel of the floating wheel via a bearing.

Preferably, at least two cash boxes are arranged in the lower machine interior, the lower channel board includes independent boards corresponding to the cash boxes respectively, gaps between the independent boards correspond to bank note entrances/exits of the cash boxes, and a redirection mechanism is arranged at each of the gaps for changing the direction of the banknote and guiding the banknote to enter/exit the cash boxes.

Further, an end of each of the independent boards that is close to the redirection mechanism is pivoted to the channel support, and the other end is connected to the channel support via a spring.

Preferably, an elastic member is arranged at the end with the spring of each of the independent boards and on a side that faces the cash boxes, and the elastic member is adapted to secure a stable positional relationship between the conveying channel device and the cash boxes.

Preferably, the drive shaft of the conveying belt and the auxiliary conveying wheel set are driven by a synchronous belt so that the banknote is conveyed at a fixed speed.

Preferably, a speed detecting code wheel is arranged in the conveying channel, the speed detecting code wheel is driven by a shaft synchronized with the drive shaft, and the speed of the speed detecting code wheel is detectable by a U-shaped sensor.

Therefore, the banknote conveying channel device provided by the invention has the following advantages over the prior art:

1. The floating wheel arranged in the redirection locations may increase the force on the banknote being redirected, so that banknotes can be brought into the horizontal channel device smoothly from the upper machine interior after being sorted.

2. By the spring connection of the grouped channel boards, the coupling relationship between the channel boards and the channel support is secured. Accordingly, cash deposit and withdrawal are enabled even if the case cash box rack is not fully filled with cash boxes, thereby improving operational performance of the machine and utilization of cash boxes.

DETAILED DESCRIPTION OF THE INVENTION

Technical solutions of the embodiments of the invention are clearly and fully described below in connection with the figures of the embodiments of the invention. It should be noted that the embodiments described herein are only some of the possible embodiments of the invention. Other embodiments, which are obtained by those skilled in the art based on the embodiments described herein without inventive efforts, should be included in the scope of the invention.

Figure 1:
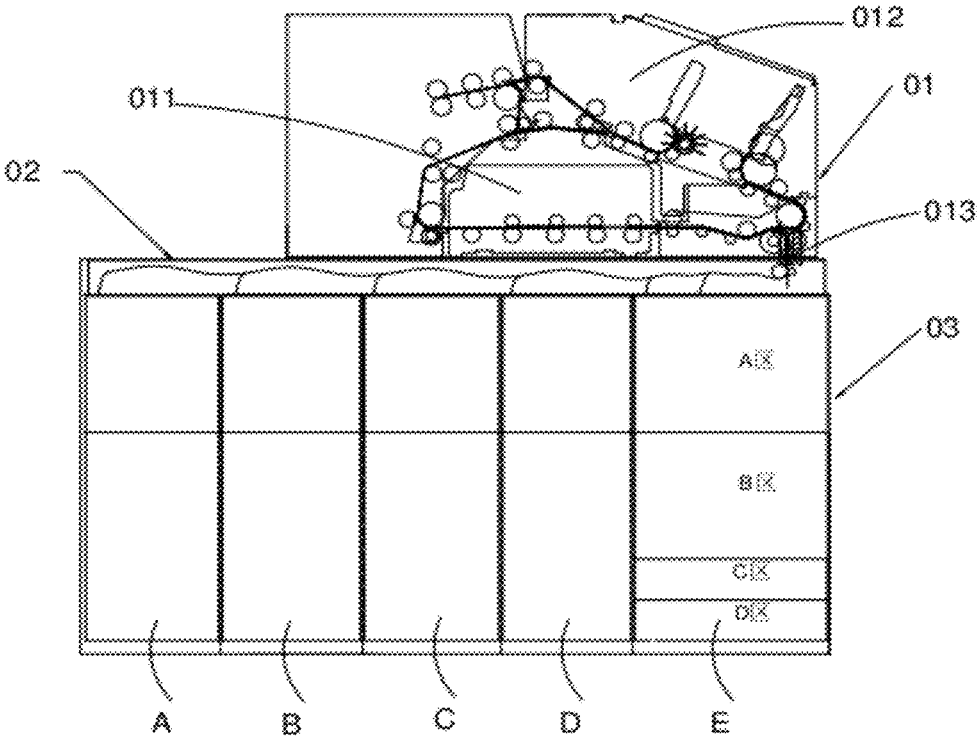
FIG. 1 is a structural diagram of a machine interior of an automated cash deposit and withdrawal machine provided by an embodiment.

Now refer to FIG. 1, a structural diagram of a machine interior of an automated cash deposit and withdrawal machine provided by an embodiment of the invention. The machine interior includes an upper machine interior, which further includes a banknote identification module 011 and a sorting module 012, a banknote conveying channel 02, and a lower machine interior which includes multiple cash boxes. After banknotes 10 are put into the automated cash deposit and withdrawal machine, the banknotes 10 are sorted by the sorting module, then go through the banknote identification module 011 one by one. For those banknotes that are validated for deposit, they go through the vertical machine interior connection mechanism channel 013, and enter the horizontal banknote conveying channel 02. The banknote conveying channel 02 conveys the banknotes to a corresponding cash box as instructed by a control center (not shown).

Figure 2:
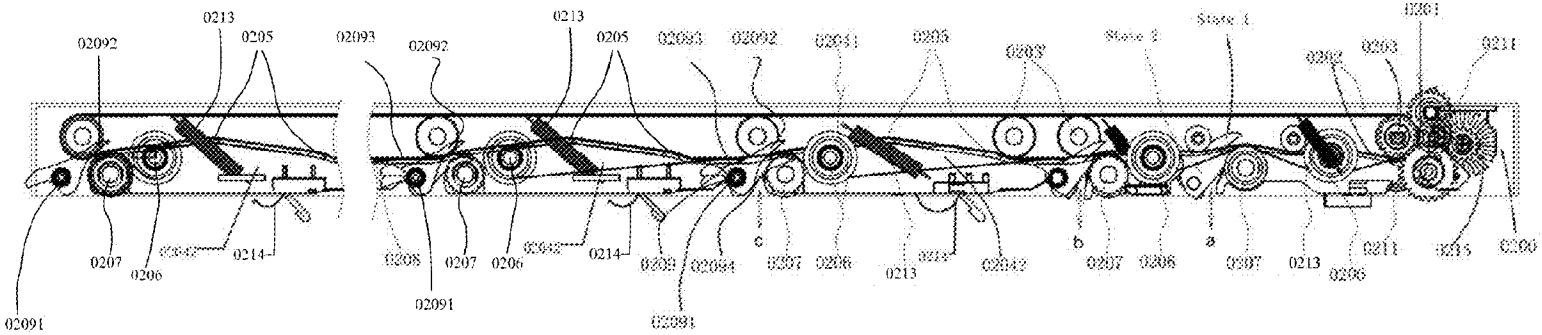
FIG. 2 is a side view of a banknote conveying channel device of the invention.
Figure 6:
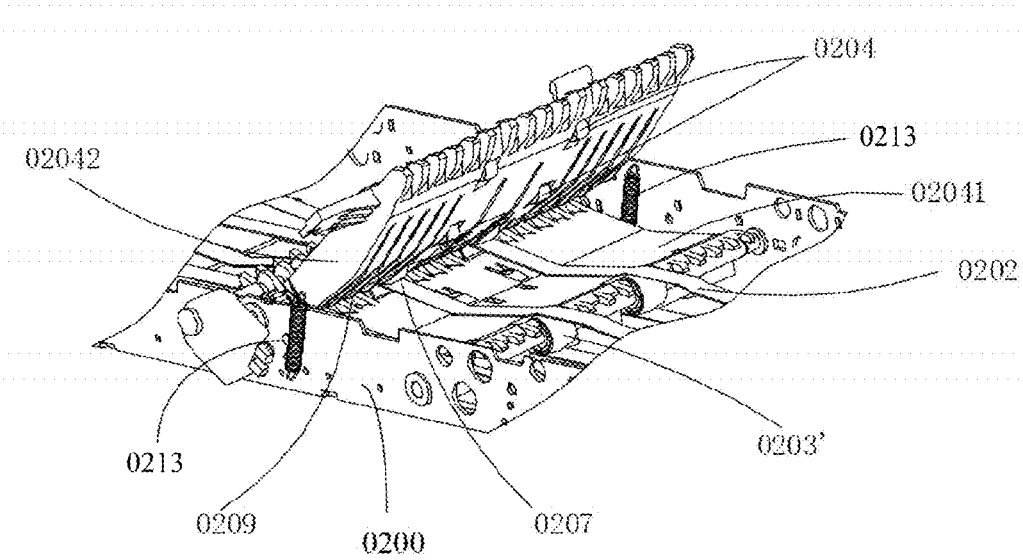
FIG. 6 is a local view of an opened channel board of a banknote conveying channel device of the invention.

Refer to FIG. 2, a side view of a preferred banknote conveying channel according to an embodiment of the invention. The banknote conveying channel includes: a banknote entrance/exit 0201 connecting to the machine interior connection mechanism channel 013; a conveying belt 0202; drive shafts 0203 of the conveying belt 0202; conveying channel boards fitted with the conveying belt 0202 such that the conveying belt 0202 is sandwiched between the conveying channel boards; and a channel support 0200 supporting the members above. The conveying belt 0202 is tensioned on two sets of drive shafts 0203. For long distance conveying on a banknote conveying channel with multiple cash boxes, in addition to the tensioning drive shafts 0203 arranged at both ends, multiple sets of belt tensioning drums 0203' may be arranged in some appropriate locations in the middle of the conveying belt 0202, so that the vibration of the belt due to long distance transmission can be reduced, and stability of conveying can be improved. With reference to FIG. 6 and FIG. 2, for proper conveying of banknotes, the channel boards are classified as upper channel boards and lower channel boards. Multiple sets of channel guiding wheels 0205 are arranged on the upper channel board 02041 and are fitted with the lower channel board 02042 such that the conveying belt 0202 is sandwiched between a channel guiding wheel 0205 and the lower channel board 02042. A tensioning wheel 0206 and a banknote holding wheel 0207 are arranged close to the lower channel board 02042 and are fitted with the conveying belt 0202 such that the conveying belt 0202 is sandwiched therebetween. The channel guiding wheels 0205 are arranged appropriately along the conveying direction of the banknotes. The banknote holding wheel 0207 is arranged at a cash box entrance/exit (a, b, c . . . ) of the conveying channel 02. The distance between any two of the belt tensioning drums 0203', the channel guiding wheels 0205, the tensioning wheels 0206 and the banknote holding wheels 0207 is smaller than the length of a banknote in its conveying direction, so that the banknotes being conveyed in the channel are under a force the whole time. Preferably, the belt tensioning drums 0203 and the banknote holding wheels 0207 are arranged in the banknote conveying channel 02 in locations corresponding to the cash box entrances/exits, so that the force on the banknotes being redirected is improved, and the banknotes can be brought into the cash boxes smoothly. In addition, for stability of the force on the banknotes being conveyed and for consistency of speeds, all of the belt tensioning drums 0203', the channel guiding wheels 0205, the tensioning wheels 0206 and the banknote holding wheels 0207 are driven by a synchronous belt 0208.

Moreover, a channel redirection mechanism is arranged in the banknote conveying channel 02 in each of the locations corresponding to the cash box entrances/exits. The redirection mechanism includes a triangle-shaped redirection member 0209, and a rotating shaft 02091 which drives the redirection member 0209 to rotate. The redirection member 0209 includes a path changing angle 02092, and the two sides forming the path changing angle 02092 make a banknote horizontal conveying surface 02093 and a redirection guiding surface 02094. Driven by the rotating shaft 02091, the redirection member 0209 has two interchangeable states: state 1 and state 2. In state 1, the path changing angle 02092 of the redirection member 0209 inserts the conveying channel 02, cuts off the horizontal conveying path, and redirects the banknotes with the guiding surface 02094, letting the banknotes enter or exit the cash boxes as driven by the banknote holding wheel 0207 and/or the belt tensioning drum 0203 in the redirection location. In state 2, the path changing angle 02092 of the redirection member 0209 is out of the banknote horizontal conveying path of the conveying channel 02, and the horizontal conveying surface 02093 of the redirection member 0209 is parallel to the banknote horizontal conveying path of the conveying channel 02, and forms a horizontal conveying path for the banknotes together with the channel boards.

Figure 3:
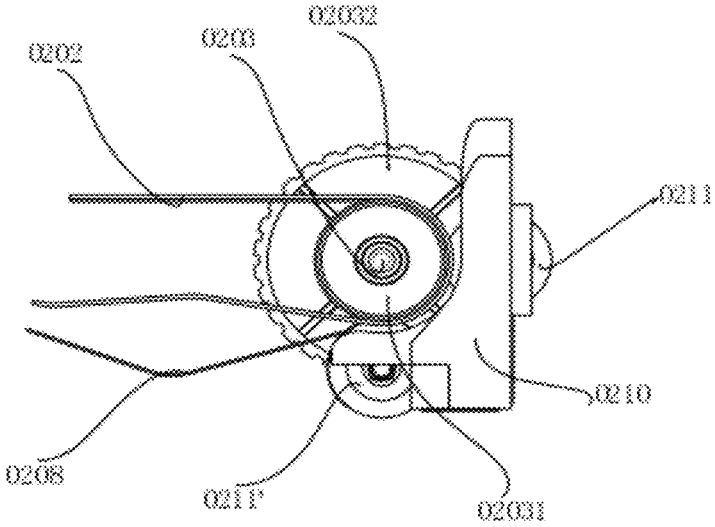
FIG. 3 is a side view of a redirection location of a banknote conveying channel device of the invention.
Figure 4:
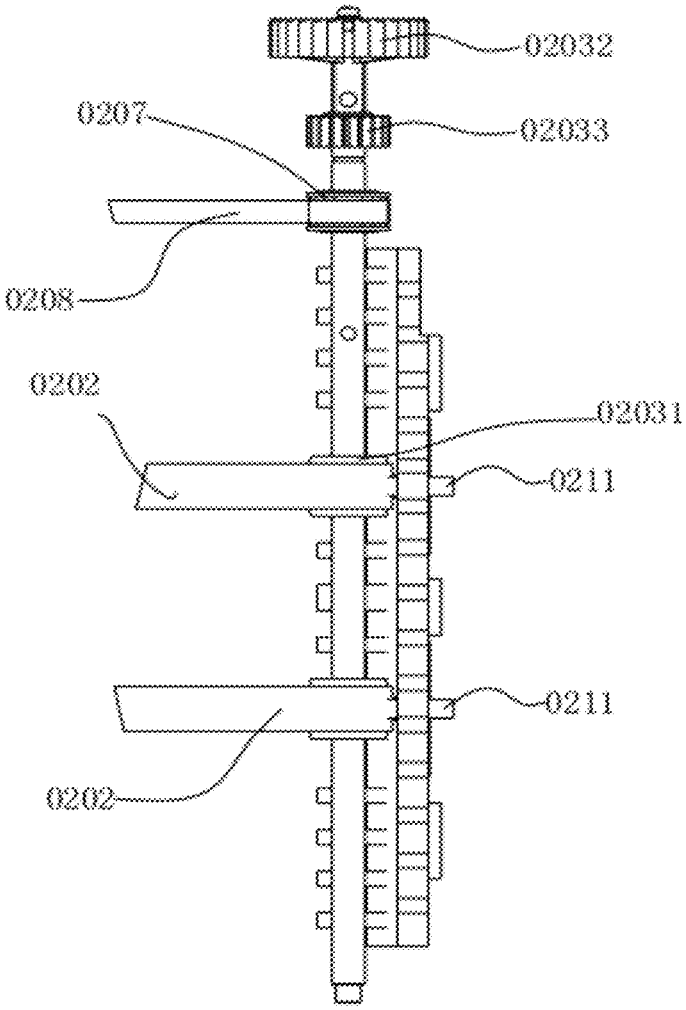
FIG. 4 is a top view of a redirection location of a banknote conveying channel device of the invention.

Now refer to FIG. 2, FIG. 3 and FIG. 4. FIG. 3 is a local side view of a banknote entrance/exit 0201 of a banknote conveying channel according to an embodiment of the invention; and FIG. 4 is a top view of the banknote entrance/exit 0201 of the banknote conveying channel according to the embodiment of the invention. In order to solve the problem that it is difficult to redirect banknotes in the vertical plane, this embodiment provides a conveying method different from the conventional one which uses two belts to contain the banknotes being redirected. With reference to FIG. 3 and FIG. 4, a redirection guiding plate 0210 is arranged at an entrance/exit of the conveying channel; the redirection guiding plate 0210 and the conveying belt 0202 form a banknote redirection conveying path; and a floating wheel for assisting redirection is arranged on the redirection guiding plate 0210. Preferably, two floating wheels are arranged at an entrance and an exit for banknotes of the redirection conveying path, where the banknotes enter the conveying channel vertically, respectively, i.e., a vertical floating wheel 0211 at the end of the machine interior connection mechanism and a horizontal floating wheel 0211' at the beginning of the horizontal conveying channel. The floating wheels 0211 and 0211' are fitted with the drive shaft 0203 such that the conveying belt 0202 is sandwiched between the floating wheels 0211 and 0211' and the drive shaft 0203. Preferably, a rubber drum 02031 is arranged on the drive shaft 0203, and the conveying belt 0202 is tensioned on the rubber drum 02031 such that the conveying belt 0202 and the floating wheels 0211 and 0211' rotate in opposite directions. The drive shaft 0203 obtains a system driving force from a gear 02033, for power transmission of the drive shaft. In addition, as banknote jams often occur in redirection locations, in order to clear banknote jams more conveniently, a manually rotatable knob 02032 is connected to the drive shaft. Therefore, by manually rotating the knob 02032, which drives the drive shaft 0203 and the conveying belt 0202 to rotate, jammed banknotes can be brought out of the conveying channel.

Figure 5:
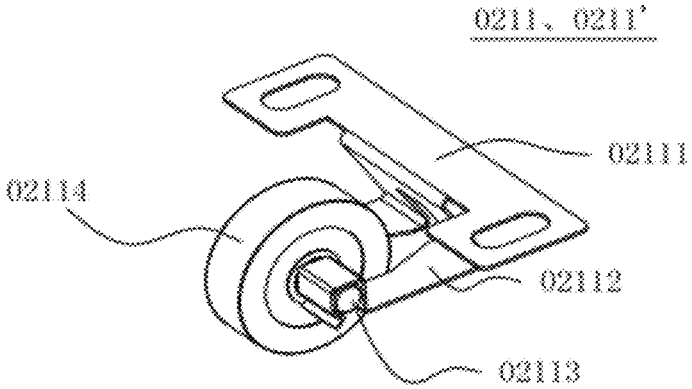
FIG. 5 is a perspective view of a floating wheel mechanism of a banknote conveying channel device of the invention.

Refer to FIG. 5, a perspective view of a preferred floating wheel provided by an embodiment of the invention. The floating wheel 0211/0211' is mounted on the redirection guiding plate 0210 via a mounting plate 02111. The mounting plate 02111 includes two elastic arms 02112. The two elastic arms 02112 clamp a floating wheel axle 02113, and the floating wheel axle 02113 is fitted with a rotating wheel 02114 via a bearing. The elastic arms 02112 of the floating wheel 0211/0211' may ensure the force between the conveying belt 0202 and the rotating wheel 02114 that holds banknotes is at a substantially fixed value, and allow banknotes with different thicknesses to pass.

Refer to FIG. 2 and FIG. 6. As banknotes are to enter respective cash boxes as instructed after being conveyed by the conveying channel 02, banknote entrances/exits a, b, c and the like are arranged in the conveying channel 02 in locations corresponding to cash box openings, and conveyed banknotes enter/exit respective cash boxes through the entrance/exits a, b or c. A redirection operation is performed when a banknote enters/exits a cash box; a corresponding redirection mechanism is arranged in each of the locations where redirection is needed. As banknote jams often occur where redirection operations are performed, in order to clear banknote jams more conveniently, each of the lower channel boards corresponding to a cash box is designed as an independent board. The gaps between the independent boards correspond to banknote entrances/exits of the cash boxes, and the redirection mechanisms discussed above are arranged at the gaps, for changing the direction of the banknotes and guiding the banknotes to enter/exit the cash boxes. An end of the independent board close to the cash box opening is pivoted to the channel support 0200, and the other end is connected to the channel support 0200 via a spring 02013. Accordingly, the independent boards allow banknote conveying even without the support from cash boxes. Therefore, a stable conveying path can be formed in the conveying channel even if the cash box underneath are not full. If a banknote jam occurs somewhere while the banknotes are being conveyed, the pivotable independent board can be opened to expose the jammed banknotes, letting the operating staff to clear the banknote jam conveniently. By the spring connection, a relative positional relationship between the independent boards and the upper channel boards 02041 is maintained; and the independent boards and the upper channel boards form a stable banknote conveying channel without the support from other members. The stable banknote conveying channel is good for stable conveying of banknotes and may reduce the probability of banknote jams. In addition, a cash box elastic member 0214 is arranged on the independent board. When the conveying channel 02 and the cash boxes are mounted in place, the elastic member 0214 may effectively secure a stable positional relationship between the cash boxes and the conveying channel 02, which further ensures stable conveying of banknotes. While the machine is in operation, the operating of the channel or other members may cause vibration of the machine. And the elastic member between the conveying channel 02 and the cash boxes can effectively absorb the vibration, hence secure the relative position between the conveying channel and the cash boxes, thereby ensuring table conveying of banknotes.

By the spring connection, a relative positional relationship between the independent boards and the upper channel boards 02041 is maintained. In the case with multiple cash boxes, even if some of the box positions are empty, the independent boards of the banknote conveying boards still form a stable banknote conveying channel with the upper channel boards 02041 with the help of the springs. Accordingly, cash deposit and withdrawal are enabled even if the case cash box rack is not fully filled with cash boxes, thereby improving operational performance of the machine and utilization of cash boxes.

Figure 7:
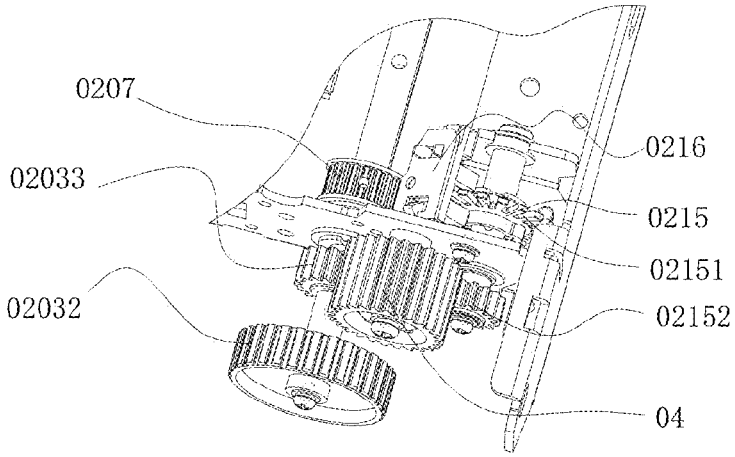
FIG. 7 is a diagram illustrating a code wheel mechanism of a banknote conveying channel device of the invention for detecting the speed of the drive shaft.

Refer to FIG. 2 and FIG. 7. A speed detecting mechanism is arranged in the conveying channel for detecting the conveying speed of banknotes in the banknote conveying channel. The detecting mechanism includes a code wheel 0215 synchronized with the drive shaft 0203, and a U-shaped counting sensor 0216. For synchronized rotation, a gear 02033 on the drive shaft 0203 and a coaxial gear 02152 of the code wheel 0215 both engage with a power transmission gear 04. The code wheel 0215 is a round rotatable wheel with evenly distributed slots 02151 in its radial direction, and is inserted in the U-shaped counting sensor 0216. While the code wheel is rotating, the counting sensor 0216 detects the rotating speed of the rotating shaft based on a passing frequency of the slots 02151, and computes at once the conveying speed of the conveying belt 0202. Based on real-time speed monitoring by the code wheel 0215, the speeds of the banknote conveying channel and the upper machine interior conveying banknotes can be coordinated.

Banknote conveying processes for cash deposit and withdrawal operations are described below with reference to the figures.

With reference to FIG. 1 to FIG. 7, normally multiple cash boxes are included in a lower machine interior of an automated cash deposit and withdrawal machine. Base on their functions, the cash boxes may further be classified as recycling cash boxes (A, B, C and D) and a deposit only cash box (E). The recycling cash boxes are for storing banknotes that are suitable for further circulation, and the deposit only cash box is for storing banknotes that are not suitable for further circulation or suspicious. When the automated cash deposit and withdrawal machine are providing deposit service, a stack of banknotes are sorted by a sorting module 012, then enter identification module 011. When they are identified and validated for deposit, the banknotes are conveyed one by one to a vertical machine interior connection mechanism channel 013. Going through the machine interior connection mechanism channel 013, a banknote enters a horizontal conveying channel 02 via a banknote entrance/exit 0201. While entering the conveying channel 02, the banknote is held between a conveying belt 0202 rotating clockwise and a vertical floating wheel 0211 rotating counterclockwise for redirection, during which a redirection guiding plate 0210 guides the banknote from vertical motion to horizontal motion. When the banknote has been redirected, it is held between a horizontal floating wheel 0211' and a horizontal conveying belt 0202 for horizontal conveying. Then, a belt tensioning drum 0203', a channel guiding wheel 0205 and a banknote holding wheel 0207, the distance between any two of which is smaller than the length of the banknote in its conveying direction, cooperate with the conveying belt to hold the banknote for horizontal conveying. A system instruction is issued regarding which cash box is to receive the banknote. For example, if it is determined that the banknote can be stored in a recycling cash box D, then when the banknote is conveyed to a channel banknote entrance/exit c, a redirection mechanism 0209 is rotated into state 1, which cuts off the path for the banknote to go on and let the banknote enter the recycling cash box D through a redirection guiding surface 02094, thereby accomplishing the cash deposit process. If the system instructs other recycling cash box to take the banknote, the status of the redirection mechanism at the entrance/exit c is changed into state 2, which unblocks the conveying path for the banknote and has the path closed to an entrance/exit of the recycling cash box D.

If an inputted banknote is identified as not suitable for further circulation, it enters the deposit only cash box E via a channel entrance/exit a or c. Based on their respective natures of retrieved banknotes, the deposit only cash box E may have multiple spaces for storing banknotes retrieved for different reasons.

When the automated cash deposit and withdrawal machine are providing withdrawal service, the system instructs one of the recycling cash boxes to perform banknote suction. For example, if the recycling cash box D is instructed to give out banknotes, a banknote in the recycling cash box D is separated and sucked out and conveyed to the conveying channel banknote entrance/exit c. Then, for the banknote to enter the horizontal conveying channel 02, the redirection mechanism 0209 here is put into state 1, and the conveying belt 0202 rotating counterclockwise conveys the banknote to the outside in cooperation with corresponding belt tensioning drums 0203', channel guiding wheel 0205 and banknote holding wheel 0207, during which, redirection mechanisms at both entrances/exits b and a are at state 2 so that the conveying channel 02 remains unblocked. When the banknote is to be conveyed to the machine interior connection mechanism channel, the banknote is redirected as assisted by a floating wheel 0211 and enters the vertical machine interior connection mechanism channel, then the banknote is conveyed to the upper machine interior for cash withdrawal. In the case where a user forgets to take his banknotes that are put out, the banknotes are conveyed to a forgotten banknote retrieving space of the deposit only cash box via the banknote entrance/exit a or b through the upper machine interior, the machine interior connection mechanism channel and the conveying channel 02.

Preferred embodiments are disclosed herein, which should not be considered as limiting the scope of the invention. All the equivalents made from the description and figures of the invention should be included in the scope of the invention.

The invention claimed is:

1. A banknote conveying channel device, the device being arranged between an upper machine interior for banknote identification and banknote sorting and a lower machine interior for banknote storage, and being adapted to convey, with redirection, and to separate banknotes, and the device comprising:

a channel support, adapted to be mounted with a banknote conveying channel;

a conveying belt, tensioned on a drive shaft and adapted to convey a banknote;

a channel board, arranged on the channel support and comprising an upper channel board and a lower channel board, wherein:

a banknote conveying path is formed between the upper channel board and the lower channel board, the conveying belt is sandwiched between the upper channel board and the lower channel board, and the banknote is conveyed by the conveying belt in the path formed by the upper channel board and the lower channel board;

at least one auxiliary conveying wheel set arranged on the channel support and adapted to cooperate with the conveying belt for power transmission; and a redirection guiding plate arranged at an end of the banknote conveying channel device where the banknote enters and forming a banknote redirection path with the conveying belt;

wherein, at least one floating wheel is arranged in the redirection path, the at least one floating wheel is fitted with the drive shaft of the conveying belt such that the conveying belt is sandwiched between the at least one floating wheel and the drive shaft, and the at least one floating wheel and the conveying belt form a rolling friction-based assembly;

at least two cash boxes are arranged in the lower machine interior, the lower channel board comprises independent boards corresponding to the cash boxes respectively, gaps between the independent boards correspond to bank note entrances/exits of the cash boxes, and a redirection mechanism is arranged at each of the gaps for changing the direction of the banknote and guiding the banknote to enter/exit the cash boxes;

an end of each of the independent boards that is close to the redirection mechanism is pivoted to the channel support, and the other end is connected to the channel support via a spring.

2. The banknote conveying channel device according to claim 1, wherein the at least one floating wheel is arranged at each of an entrance and an exit of the redirection path.

3. The banknote conveying channel device according to claim 1, wherein a rubber drum is arranged on the drive shaft, and the conveying belt is tensioned on the rubber drum such that the conveying belt and the at least one floating wheel rotate in opposite directions.

4. The banknote conveying channel device according to claim 1, wherein the at least one floating wheel is mounted on the redirection guiding plate via a mounting plate, the mounting plate comprises two elastic arms, the two elastic arms clamp a floating wheel axle, and the at least one floating wheel axle is fitted with a rotating wheel of the at least one floating wheel via a bearing.

5. The banknote conveying channel device according to claim 1, wherein an elastic member is arranged at the end with the spring of each of the independent boards and on a side that faces the cash boxes, and the elastic member is adapted to secure a stable positional relationship between the cash boxes and the rest of the banknote conveying channel device.

6. The banknote conveying channel device according to claim 1, wherein the drive shaft of the conveying belt and the auxiliary conveying wheel set are driven by a synchronous belt so that the banknote is conveyed at a fixed speed.

7. The banknote conveying channel device according to claim 1, wherein a speed detecting code wheel is arranged in the conveying channel, the speed detecting code wheel is driven by a shaft synchronized with the drive shaft, and the speed of the speed detecting code wheel is detectable by a U-shaped sensor.

* * * * *